United States Patent [19]

Croll et al.

[11] 4,025,039

[45] May 24, 1977

[54] CARTON FOR CARD-MOUNTED GOODS AND THE LIKE

[76] Inventors: Monte B. Croll, 8202 Douglass Road, Wyndmoor, Pa. 19118; Lionel Croll, 10 W. 15th St., Barnegat Light, N.J. 08006

[22] Filed: July 26, 1976

[21] Appl. No.: 708,432

[52] U.S. Cl. ..... 229/27; 229/15; 229/38; 206/563; 206/485; 206/491

[51] Int. Cl.[2] ..... B65D 5/48; B65D 73/02

[58] Field of Search ..... 229/27, 15, 38, 14 C, 229/34 HW; 206/485, 526, 73, 461, 491

[56] References Cited

UNITED STATES PATENTS

| | | | |
|---|---|---|---|
| 2,306,624 | 12/1942 | Harris | 206/485 |
| 2,596,261 | 5/1952 | Liskin | 229/38 X |
| 3,302,776 | 2/1967 | Sparks | 206/73 X |
| 3,313,407 | 4/1967 | Palm | 206/491 |
| 3,856,137 | 12/1974 | Brindley | 206/73 |

FOREIGN PATENTS OR APPLICATIONS

| | | | |
|---|---|---|---|
| 965,621 | 2/1950 | France | 206/485 |
| 1,017,919 | 10/1952 | France | 206/485 |
| 475,578 | 11/1952 | Italy | 229/14 C |
| 393,630 | 6/1933 | United Kingdom | 206/485 |
| 397,047 | 8/1933 | United Kingdom | 229/27 |
| 427,218 | 4/1935 | United Kingdom | 229/27 |

*Primary Examiner*—Robert S. Ward, Jr.
*Attorney, Agent, or Firm*—Robert K. Youtie

[57] ABSTRACT

A carton for card-mounted goods including bottom, side, end and top walls, inner side walls spaced inwardly from the outer side walls, the inner side walls having downwardly extending slots for receiving opposite margins of cards with the goods between the inner side walls, and flap means depending from the top wall removably into opposed slots.

8 Claims, 5 Drawing Figures

CARTON FOR CARD-MOUNTED GOODS AND THE LIKE

BACKGROUND OF THE INVENTION

In the card-mounted or carded packaging of hardware, and similar goods, the handling and shipment of smaller than wholesale quantities may become inconvenient, time-consuming and troublesome, especially as such handling often results in damage to the card and/or the holding blister or skin.

This is particularly true with hardware products and other relatively heavy products which heretofore have tended to soil, crease, bend and tear the cards, skins and blisters.

while the carton of the present invention has been developed and primarily employed for use in connection with card-mounted goods, it is understood that other goods of similar outline configuration so as to have oppositely extending flanges may utilize the instant invention with equally advantageous results, and are intended to be comprehended herein within the designation of card-mounted goods, carded packages, and the like.

SUMMARY OF THE INVENTION

It is, therefore, an important object of the present invention to provide a unique and highly improved construction of carton in which smaller, such as less than wholesale, quantities of card packaged hardware and other items may be conveniently packed and removed therefrom, and which are effectively protected in handling, storage and shipment from being damaged, particularly from damage to the card skin and blister.

It is a more particular object of the present invention to provide a carton construction for containing card packed hardware wherein the cards are effectively restrained against damaging edge impact with the carton, and the blisters, skins and goods are held apart from each other, all to insure an extremely low rate of damage.

It is still another object of the present invention to provide a carton construction containing carded packages wherein the packages cooperate with the carton construction to enhance rigidity of the latter for improved structural strength of the carton and greater protection to the contents.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described and of which the scope will be indicated by the appended claims.

DESCRIPTION OF THE PREFERRED EMBODIMENT

Figure 2:
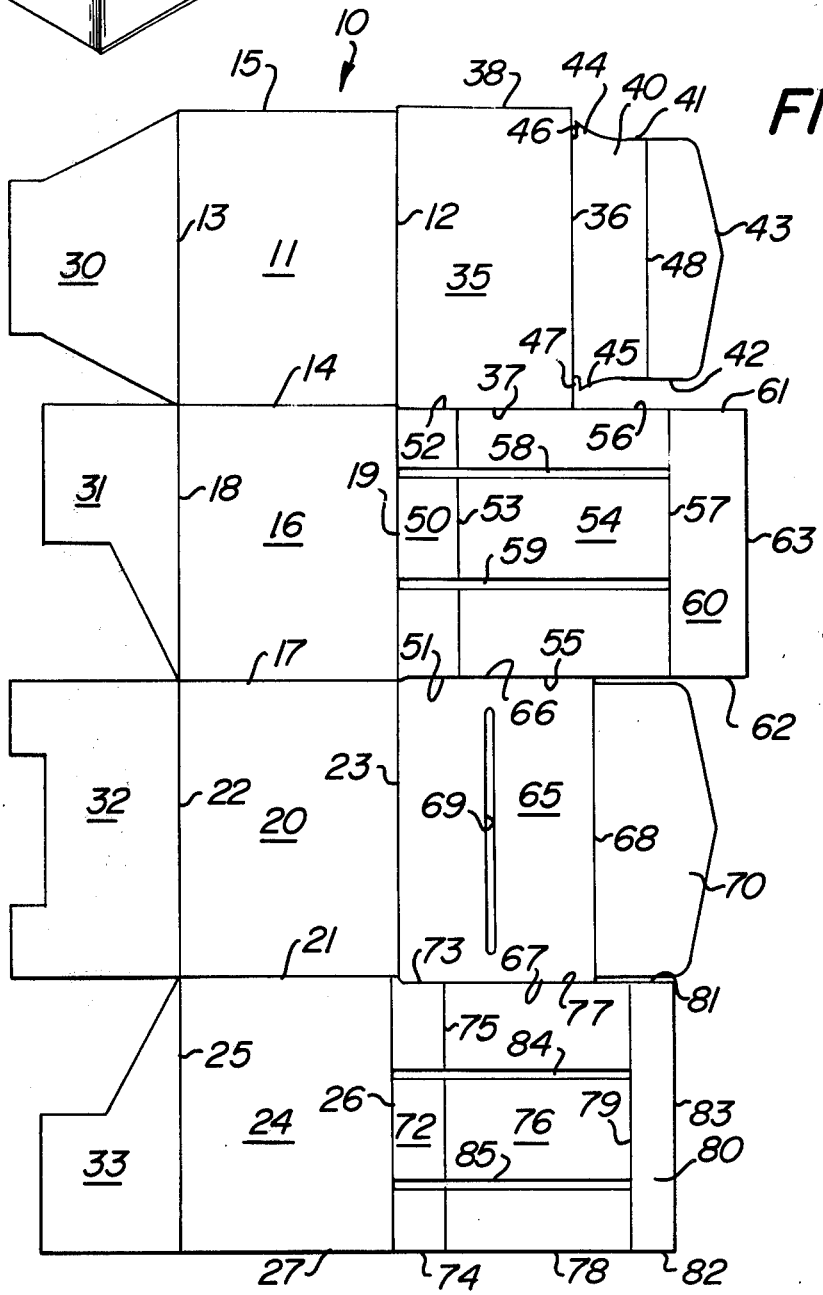
FIG. 2 is a plan view showing a blank adapted to be formed into a carton of the present invention.

Referring now more particularly to the drawings, and specifically to FIG. 2 thereof, a blank is there generally designated 10, and may be integrally fabricated, say of corrugated cardboard, or other suitably stiff flexible material, properly cut and scored. The blank 10 may include a generally rectangular end wall panel 11 bounded by parallel spaced foldlines 12 and 13, an additional foldline 14 extending between one pair of ends of the foldlines 12 and 13, and an edge 15 parallel to the foldline 14 extending between the other pair of ends of foldlines 12 and 13. Hingedly connected to the end wall panel 11, as by the foldline 14, is a generally rectangular side wall panel 16 bounded within the foldline 14 and an opposite parallel foldline 17, and a pair of parallel foldlines 18 and 19 respectively extending between the foldlines 14 and 17. An additional end wall panel 20 is hingedly connected to the side wall panel 16 by the foldline 17, and is bounded within the latter foldline and a parallel foldline 21, and a pair of parallel foldlines 22 and 23 extending between the foldlines 17 and 21. Another side wall panel 24 is generally rectangular and hingedly connected to the end wall panel 20 by the foldline 21, being bounded within the latter foldline, a pair of generally parallel foldlines 25 and 26 extending from opposite ends of the foldline 21 generally normal thereto, and an edge 27 extending between the foldlines 25 and 26 remote from the foldline 21. The foldlines 13, 18, 22 and 25 may all be in end-to-end alignment, and respectively provided with interfitting bottom wall panels 30, 31, 32 and 33, as will appear more fully hereinafter.

The foldlines 12, 19, 23 and 26 of panels 11, 16, 20 and 24, respectively, are also in general end-to-end alignment with each other.

A top wall panel or cover part 35 is generally rectangular, being hingedly connected to the panel 11 along foldline 12, substantially coextensive therewith. The top wall panel 35 may be bounded within the hinged connection or foldline 12, and a foldline 36 generally parallel to the foldline 12, and a pair of generally parallel opposite edges 37 and 38 extending between opposite ends of the foldlines 12 and 36. Hingedly connected to the foldline 36 of top part panel 35 may be a flap 40 which may extend from the foldline 36 between a pair of generally parallel edges 41 and 42 to a generally tapering or convergent free end edge 43. The opposite side edges 41 and 42 may be provided with outstanding ears 44 and 45, respectively, adjacent to and spaced from the foldline 36 by notches 46 and 47, respectively. An intermediate foldline 48 may be provided in the flap 40, extending between edges 41 and 42 and spaced intermediate the foldline 36 and end edges 43.

A generally rectangular shelf panel 50 is hingedly connected to the panel 16 along the foldline 19, being generally coextensive therewith, and is bounded within the foldline 19, a pair of parallel edges 51 and 52 extending from opposite ends of the foldline 19, and a foldline 53 generally parallel to the foldline 19. An inner wall panel 54 is generally rectangular, being hingedly connected to and extending from the foldline 53, bounded within the latter foldline, a pair of parallel edges 55 and 56 extending from opposite ends of the foldline 53, and a foldline 57 extending between the edges 55 and 56. A pair of slots 58 and 59 extend in general parallelism with each other, being formed in shelf panel 50 and inner wall panel 54, extending between foldlines 19 and 57, spaced intermediate foldlines 55 and 56. Thus, the slots 58 and 59 intersect with foldline 53 and subdivide the shelf and inner wall panels 50 and 54. An additional generally rectangular spacer panel 60 is hingedly connected by foldline 57 to the inner wall panel 54, being generally coextensive with the latter foldline, and bounded within the same and parallel edges 61 and 62 extending from opposite ends of foldline 57, and an edge 63 extending between the edges 61 and 62.

A generally rectangular additional top part panel 65 is hingedly connected to and generally coextensive with panel 20 by foldline 23, being bounded within the latter, parallel edges 66 and 67, and a foldline 68 extending between the parallel edges and parallel to foldline 23. A slot or passageway 69 is formed in panel 65, extending in parallelism with and spaced intermediate the foldlines 23 and 68, toward and terminating short of edges 66 and 67. Hingedly connected to the panel 65 by foldline 68 is a flap 70, which may be substantially coextensive with or slightly shorter than the foldline 68.

Hingedly connected to the panel 24 by foldline 26 and generally coextensive therewith is another generally rectangular shelf panel 72 bounded within the foldline 26, opposite edge 73 and 74 extending from opposite ends of the foldline 26, and a foldline 75 extending between the edges 73 generally parallel to the foldline 76. A generally rectangular inner wall panel 76 is hingedly connected by the foldline 75 to the shelf panel 72, being generally coextensive therewith, and bounded within the foldline 76, parallel edges 77 and 78 extending from opposite ends of the foldline 75, and a foldline 79 parallel to foldline 75 extending between edges 77 and 78. A generally rectangular spacer panel 80 is hingedly connected by the foldline 79 to the inner wall panel 76, being coextensive therewith, and bounded within the foldline 79, parallel edges 81 and 82, and an edge 83 extending between the edges 81 and 82 generally parallel to the foldline 79. The spacer panels 80 and 60 may each be generally congruent to its respective associated shelf panel 72 and 50. The inner wall panel 76 and shelf panel 72 are formed with a pair of grooves 84 and 85 extending in substantial parallelism with each other, intermediate the side edges 77 and 78, and terminating at foldlines 26 and 79. Thus, the grooves 84 and 85 intersect with foldline 75 and subdivide the shelf and inner wall panels 72 and 76.

Figure 1:
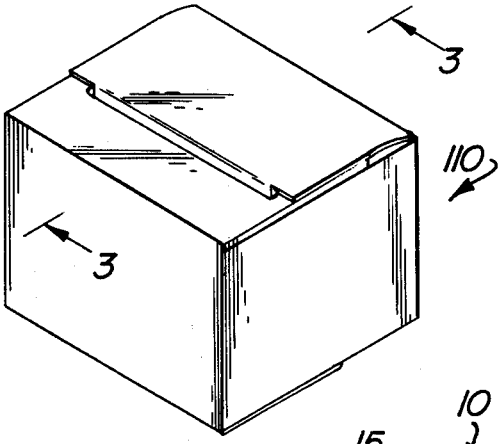
FIG. 1 is a top perspective view showing a carton of the present invention in its closed condition of shipment or storage.
Figure 5:
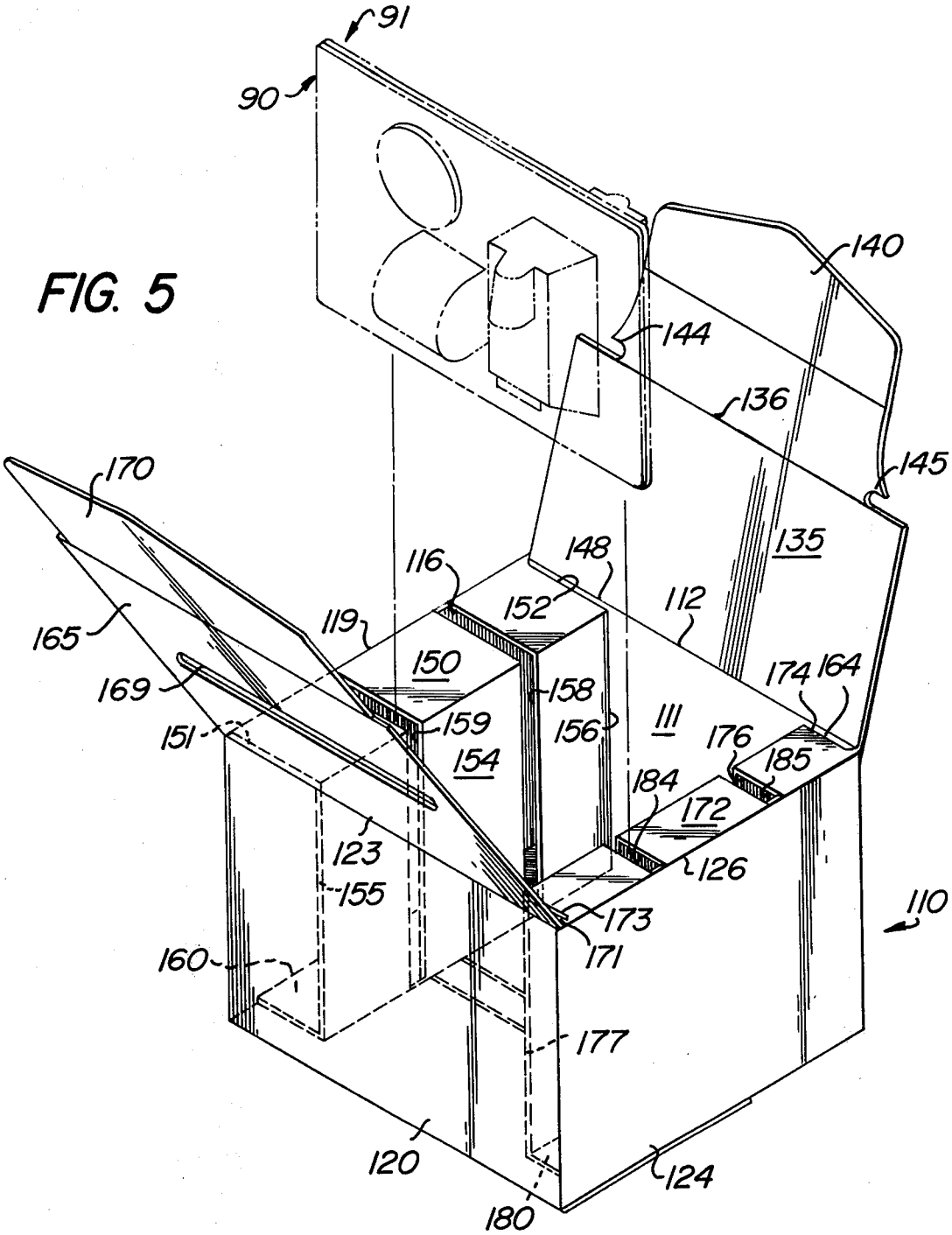
FIG. 5 is an exploded perspective view showing the carton of the present invention in open condition, as for loading and unloading of contents.

In the erected condition, the blank 10 of FIG. 1 is folded and secured to form a carton 110, as may be seen in FIGS. 1 and 5. The panels 11, 16, 20 and 24 of the blank 10 are swung about their connective foldlines 14, 17 and 21 into a generally rectangular relation to respectively define upstanding outer walls 111, 116, 120 and 124. The outer walls 116 and 124 may be considered as side walls, and the outer walls 111 and 120 may be considered as end walls. The panels 30, 31, 32 and 33 are swung inwardly in a conventional manner to interfit and define a bottom wall 130, from the side and end edges of which upstand the side and end walls 116, 124, 111 and 120. The shelf panels 150 and 172 are swung about their respective hinged connections 119 and 126 to extend inwardly from the upper edges of side walls 116 and 122, while the inner wall panels 154 and 176 depend generally vertically from the inner edges of respective shelf panels 150 and 172 in inwardly spaced relation with respect to adjacent outer side walls 116 and 124, terminating generally at the bottom wall 130. From the lower ends of inner side wall panels 154 and 176, the spacer panels 160 and 180 extend outwardly generally along the bottom wall 130 to maintain the inner side walls 154 and 176 generally vertical.

The slots 158 and 159 face laterally inwardly from inner side wall 154 and open upwardly from shelf panel 150, while the slots 184 and 185 open laterally inwardly from inner wall 176 and open upwardly from shelf 172. Further, the slots 158, 159, 184 and 185 extend generally vertically, while the slots 158 and 185 may be in laterally opposed alignment with each other, and the slots 159 and 184 are in laterally opposed alignment with each other. Also, the side edges 156 and 152 of inner side wall 154 and shelf 150 are slightly spaced from end wall 111 so as to define an additional generally vertical slot 148 opening laterally inwardly and upwardly. The other side edges 155 and 151 of inner side wall 154 and shelf 150 slightly spaced from end wall 120 so as to define an additional generally vertical slot 149 opening laterally inwardly and upwardly.

The inner side wall 176 has one side edge corresponding to edge 78 of panel 76 adjacent to and spaced from end wall 111, while the shelf 172 has one side edge 174 adjacent to and spaced from the end wall 111, so as to define a laterally inwardly and upwardly opening slot 164 in laterally opposed, generally aligned relation with slot 148. At its opposite end, inner side wall 176 is formed with side edge 177 adjacent to and spaced from end wall 120, and shelf 172 is formed with edge 173 adjacent to and spaced from end wall 120, so as to define a laterally inwardly and upwardly opening slot 171 in laterally opposed aligned relation with slot 149.

A plurality of blister-card packaged articles of hardware may be engaged in the container or box 110, a pair of such packages being shown in back-to-back facing engagement, as at 90 and 91. In such back-to-back relation, the blister-card packages may be engaged downwardly into an aligned pair of laterally opposed slots, such as slots 159 and 184. The blister-card packages are shown in packed relation in FIG. 3, where it is seen that the cards 92 and 93 of respective blister packages 90 and 91 have their lower edges resting on the spacer panels 160 and 180, being protectively spaced over the carton bottom 130. An additional pair of back-to-back blister-card packages 94 and 95 may be inserted downwardly with their opposite margins received in respective aligned slots 158 and 185, also resting on the spacer panels or pads 160 and 180. Additionally, at one or both ends of the container 110 may be an additional blister-card package, such as at 96. The package 96 may be arranged singly in back facing relation with end wall 120, with its opposite side marginal portions received in aligned inwardly facing slots. Specifically, the card of package 96 may have its opposite side edge margins engaged in respective slots 149 and 171, resting on the lower spacer panels or pads 160 and 180.

Figure 3:
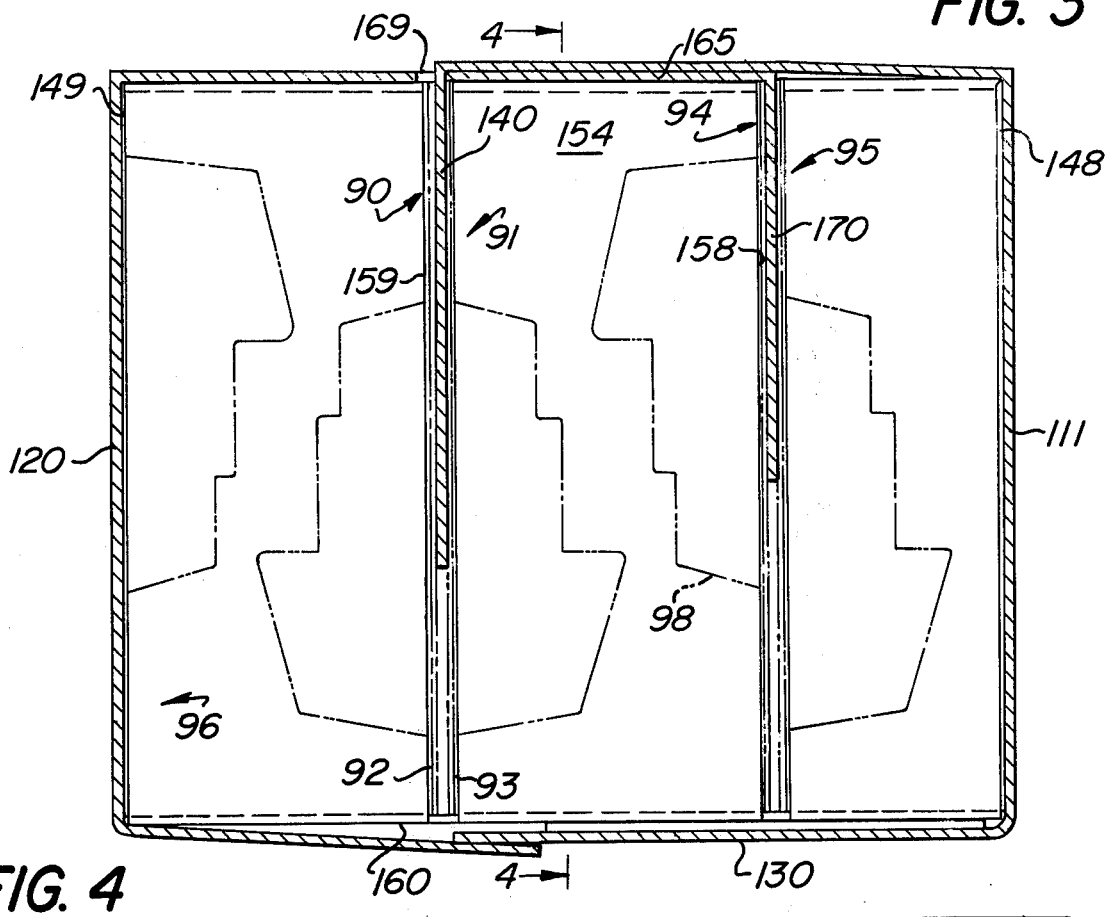
FIG. 3 is a sectional elevational view taken generally along the line 3—3 of FIG. 1, enlarged for clarity.
Figure 4:
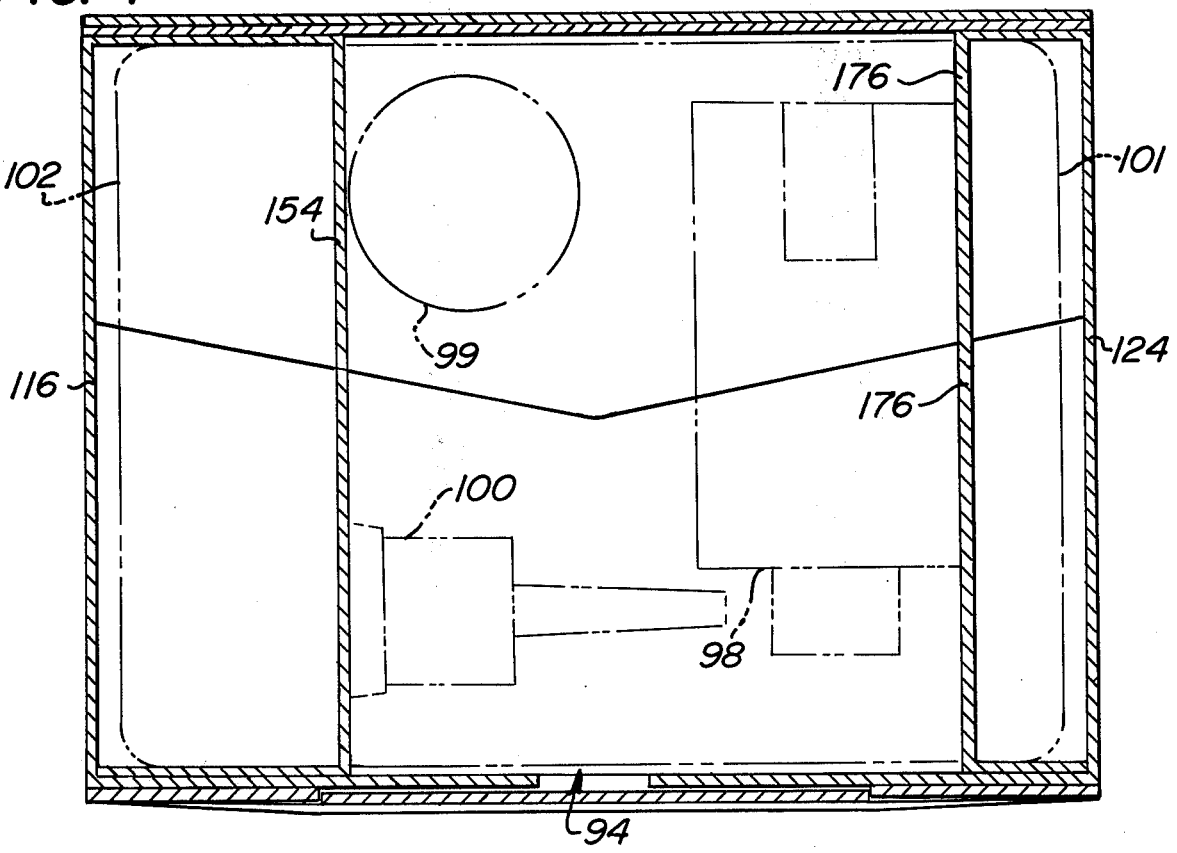
FIG. 4 is a sectional elevational view taken generally along the line 4—4 of FIG. 3.

As best seen in FIG. 3, it will be apparent that the blister elements of the packages are effectively maintained in spaced relation to avoid damaging therebetween. Further, the blister elements, such as at 98, 99 and 100 of package 94 are located for positioning engagement with respective inner side walls 154, thereby limiting or preventing edgewise displacement of the card package. In this manner, the opposite edges 101 and 102 of the card package 94 are held spaced from any possible damaging engagement with outer side walls 124 and 116, see FIG. 4. Of course, this relationship is true of all the card packages.

The panel 65 of blank 10 provides a top part 165 swingable about its hinged connection 123 to overlie the adjacent portions of shelves 150 and 172. The end tab or flap 170 is engageable downwardly into aligned grooves or slots 158 and 180, the width of the grooves or slots being such as to enable the flap or tab 170 to enter between the adjacent back-to-back blister card packages 94 and 95, see FIG. 3. In this condition the slot 69 overlies the aligned slots 159 and 184, and the received blister-card packages 90 and 91.

The additional top part 135 is swingable about its hinged connection 112 to overlie the adjacent portion of shelves 150 and 172, and the inner or lower top part 165. The tab or flap 140 is swingable about its hinged connection 136 for insertion through the slot 169 of top part 165 and entry into aligned slots 159 and 184 between adjacent back-to-back blister-card packages 90 and 91, see FIG. 3. The ears 144 and 145 of flap 140 may snap through slot 169 to lock the flap in its inserted condition. By this interfitting of flaps or tabs 170 and 140 into facing pairs of aligned slots, and between adjacent card packages, there is achieved a cross-bracing effect which substantially enhances the structural integrity of the carton 110 for resisting damage in handling, shipping and storage.

Of course, access to the contents is readily obtainable by mere upward withdrawal of tab 140 against the resistance of ears 144 and 145 to swing the outer top part 135 upwardly as shown in FIG. 5. It will also there be seen that the inner top part 160 may be swung outwardly, so that access is afforded to all the blister card packages contained in the carton 110.

While the description and drawings refer to blister packages, it is understood that the invention is equally applicable to other card-mounted packages, including skin packages, and the like.

From the foregoing, it is seen that present invention provides a carton or container which conveniently and protectively contains relatively small quantities of blister-card packaged articles, such as hardware, effecting substantial savings by resisting damage, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A carton for carded packages and the like comprising a bottom wall, a pair of outer side walls upstanding from sides of said bottom wall, a pair of end walls upstanding from opposite ends of said bottom wall, a pair of inner side walls respectively adjacent to and inwardly of said pair of outer side walls, said inner side walls each being formed with a plurality of generally downwardly extending slots for receiving opposite margins of goods mounting cards with the mounted goods between said inner side walls, cover means extending between upper regions of said outer side and end walls, and flap means depending removably from said cover means into opposed slots.

2. A carton according to claim 1, said inner side walls being hingedly connected to upper regions of said outer side walls, said slots opening upwardly for receiving said cards and flap means.

3. A carton according to claim 2, said inner side walls being spaced from said outer side walls for limiting abutment with card-mounted goods to space the cards from the outer said walls.

4. A carton according to claim 1, at least certain of said slots being of sufficient width to receive a pair of cards and said flap means.

5. A carton according to claim 1, in combination with a shelf extending inwardly from each outer side wall, said inner side walls depending respectively from said shelves, said slots extending from said inner side walls outwardly into said shelves for receiving said blister cards and flap means, and spacer means extending from a lower region of each inner side wall toward the adjacent outer side wall.

6. A carton construction according to claim 5, at least certain of said slots being of sufficient width to receive a pair of blister cards and said flap means.

7. A carton according to claim 5, said cover means comprising an inner cover part extending inwardly from one end wall toward and terminating short of the other end wall, and an outer cover part extending inwardly from said other end wall over said inner cover part toward and terminating short of said one end wall, and said flap means comprising an inner flap on said inner cover part depending into one pair of opposed slots, and an outer flap on said outer cover part depending through said inner cover part into another pair of opposed slots.

8. A carton according to claim 1, said cover means comprising an inner cover part extending inwardly from one end wall toward and terminating short of the other end wall, and an outer cover part extending inwardly from said other end wall over said inner cover part toward and terminating short of said one end wall, and said flap means comprising an inner flap on said inner cover part depending into one pair of opposed slots, and an outer flap on said outer cover part depending through said inner cover part into another pair of opposed slats.

* * * * *